US007452066B2

(12) United States Patent
Tsuji

(10) Patent No.: US 7,452,066 B2
(45) Date of Patent: Nov. 18, 2008

(54) INKJET PRINTER

(75) Inventor: Hirohiko Tsuji, Daito (JP)

(73) Assignee: Funai Electric Co., Ltd., Osaka (JP)

( * ) Notice: Subject to any disclaimer, the term of this patent is extended or adjusted under 35 U.S.C. 154(b) by 320 days.

(21) Appl. No.: 11/324,914

(22) Filed: Jan. 4, 2006

(65) Prior Publication Data

US 2006/0146110 A1 Jul. 6, 2006

(30) Foreign Application Priority Data

Jan. 4, 2005 (JP) ..... 2005-000152

(51) Int. Cl.
*B41J 2/175* (2006.01)
*B41J 29/13* (2006.01)

(52) U.S. Cl. ..... 347/108; 347/86

(58) Field of Classification Search ..... 347/86, 347/108, 84, 85; 346/145; 400/691, 692, 400/693

See application file for complete search history.

(56) References Cited

U.S. PATENT DOCUMENTS

| | | | | |
|---|---|---|---|---|
| 5,373,936 | A * | 12/1994 | Kawai et al. | 206/204 |
| 5,764,260 | A * | 6/1998 | Vu et al. | 347/87 |
| 6,059,396 | A * | 5/2000 | Choi | 347/37 |
| 6,190,010 | B1 * | 2/2001 | Tanaka | 347/108 |
| 6,309,045 | B1 * | 10/2001 | Suzuki et al. | 347/37 |
| 6,312,105 | B1 * | 11/2001 | Miyauchi | 347/49 |
| 6,585,345 | B2 * | 7/2003 | Kosugi | 347/19 |

(Continued)

FOREIGN PATENT DOCUMENTS

JP 2003-291320 10/2003

OTHER PUBLICATIONS

Patent Abstracts of Japan, Publication No. 2003-291320, dated Oct. 14, 2003 (1 page).

*Primary Examiner*—Stephen D Meier
*Assistant Examiner*—Leonard S Liang
(74) *Attorney, Agent, or Firm*—Osha • Liang LLP

(57) ABSTRACT

An inkjet printer includes a carriage body configured to receive an ink cartridge, an openable/closable cover body pivotally attached to the carriage body, a substantially L-shaped pressing member integrally formed of a resin and arranged on an underside of the cover body, a spring disposed between the cover body and the top face pressing lever for biasing the second end portion side of the top face pressing lever away from the carriage body, and a stopper arranged to prevent the back end face pressing lever from projecting flirter than necessary when the cover body is opened. The pressing member includes a top face pressing lever, having a first end portion configured to press a top face of the ink cartridge and a second end portion, and a back end face pressing lever joined integrally with the top face pressing lever at the second end portion thereof, the back end face pressing lever having a distal end portion configured to press a back end face of the ink cartridge. The pressing member is rotatably mounted to the cover body about a pivot defined at an intermediate portion of the top face pressing lever. The first end portion of the top face pressing lever is formed to have smaller flexural rigidity as compared with the second end portion, such that an elastic force of the first end portion causes the first end portion to press the top face of the ink cartridge when the cover body is closed.

10 Claims, 5 Drawing Sheets

U.S. PATENT DOCUMENTS 6,637,863 B2 * 10/2003 Jones ..... 347/49
6,655,793 B2 12/2003 Jones et al.
6,736,486 B2 * 5/2004 Nakamura et al. ..... 347/49
6,953,242 B2 * 10/2005 Yoshiyama et al. ..... 347/86
2001/0026300 A1 * 10/2001 Yamaguchi et al. ..... 347/49
2002/0085075 A1 * 7/2002 Shinada et al. ..... 347/86

* cited by examiner

INKJET PRINTER

BACKGROUND OF THE INVENTION

1. Field of the Invention

The present invention relates to an inkjet printer, and more specifically to an inkjet printer in which an ink cartridge can be securely installed.

2. Description of the Background Art

In an inkjet printer, while a carriage on which an ink cartridge is installed reciprocates, the ink supplied from the ink cartridge is injected to paper thereby printing characters and the like on the paper. Since the ink cartridge is reciprocated by the carriage, it has to be installed securely in the carriage.

Japanese Patent Laying-Open No. 2003-291320 discloses such a carriage of an inkjet printer. The carriage of the inkjet printer disclosed in Japanese Patent Laying-Open No. 2003-291320 has, as shown in FIG. 7, a carriage body 101 holding the lower portion of an ink cartridge 111 and a cover body 102 pressing the top surface of the ink cartridge. An arm 103 is provided on the bottom surface of the cover body 102. The arm 103 diagonally downward presses a protrusion 112 projecting upward from the top surface of ink cartridge 111. Arm 103 is biased downward by a first spring 104 provided between arm 103 and cover body 102 and is biased laterally by a second spring 105 provided at the back end portion of arm 103.

In the carriage of the inkjet printer disclosed in Japanese Patent Laying-Open No. 2003-291320, ink cartridge 111 is pressed by the biasing force of two springs 104 and 105. Therefore, a plurality of springs are required, thereby increasing the number of components. Moreover, a complicated structure for holding a plurality of springs is required. As a result, these requirements inevitably cause increase in the product costs.

In addition, disadvantageously, two springs need to be incorporated during the assembly of the carriage in the manufacturing process of the inkjet printer, thereby increasing the process steps in the assembly operation.

SUMMARY OF THE INVENTION

An object of the present invention is to provide an inkjet printer with a carriage On which an ink cartridge is securely installed, with a number of components, Which can be readily assembled.

An inkjet printer includes a carriage body configured to receive an ink cartridge, an openable/closable cover body pivotally attached to the carriage body, a substantially L-shaped pressing member integrally formed of a resin and arranged on an underside of the cover body, a spring disposed between the cover body and the top face pressing lever for biasing the second end portion side of the top face pressing lever away from the carriage body such that a distal end portion of the back end face pressing lever presses the back end face of the ink cartridge when the cover body is closed, and a stopper arranged to prevent the back end face pressing lever from projecting further than necessary when the cover body is opened. The pressing member includes a top face pressing lever, having a first end portion configured to press a top face of the ink cartridge and a second end portion, and a back end face pressing lever joined integrally with the top face pressing lever at the second end portion thereof, the back end face pressing lever having the distal end portion configured to press a back end face of the ink cartridge. The pressing member is rotatably mounted to the cover body about a pivot defined at an intermediate portion of the top face pressing lever. The first end portion of the top face pressing lever is formed to have smaller flexural rigidity as compared with the second end portion, such that an elastic force of the first end portion causes the first end portion to press the top face of the ink cartridge when the cover body is closed.

In this configuration, the back end face of the ink cartridge is pressed forward by the back end face pressing lever using the biasing force of the spring provided between the pressing member and the cover body. On the other hand, since the pressing member is formed in a bending shape, the top face of the ink cartridge is pressed by the top face pressing lever downward by means of the reaction force of the force created by the back end face pressing lever pressing the back end face of the ink cartridge. In this manner, the ink cartridge is pressed from two directions using one spring and one pressing member, so that the ink cartridge can be securely fixed in the carriage. As a result, the number of components of the carriage can be reduced. In addition, the assembly process steps can be reduced.

Preferably, in the inkjet printer as described above, a first end portion side from the pivot of the top face pressing lever is formed to have smaller flexural rigidity as compared with the second end portion side from the pivot. With this configuration, the second end portion side from the pivot of the top face pressing lever can reliably transmit the biasing force of the spring to the back end face of the ink cartridge because of its relatively high flexural rigidity. On the other hand, the first end portion side from the pivot of the top face pressing lever may elastically deform to some extent because of its relatively small flexural rigidity. Therefore, even with some dimensional deviations of the ink cartridge or the carriage, the top face of the ink cartridge can be pressed securely.

Preferably, in the ink cartridge as described above, a stopper is provided for preventing the back end face pressing lever biased by the spring from projecting further than necessary when the cover body is opened. This stopper may be formed of an abutment body provided on the underside of the cover body in abutment with the first end portion of the top face pressing lever. Alternatively, it may be formed of a protrusion projecting laterally from the side face of the top face pressing lever in the vicinity of the second end portion, and an abutment body in abutment with the protrusion. Provision of the stopper can prevent the back end face pressing lever from unnecessarily projecting when the cover body is opened. Therefore, when the cover body is closed, the back end face pressing lever can always be brought into abutment with the back end face of the ink cartridge from a certain direction.

In accordance with the present invention, it is possible to provide an inkjet printer with a carriage on which an ink cartridge is securely installed, with a small number of components, which can be readily assembled.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
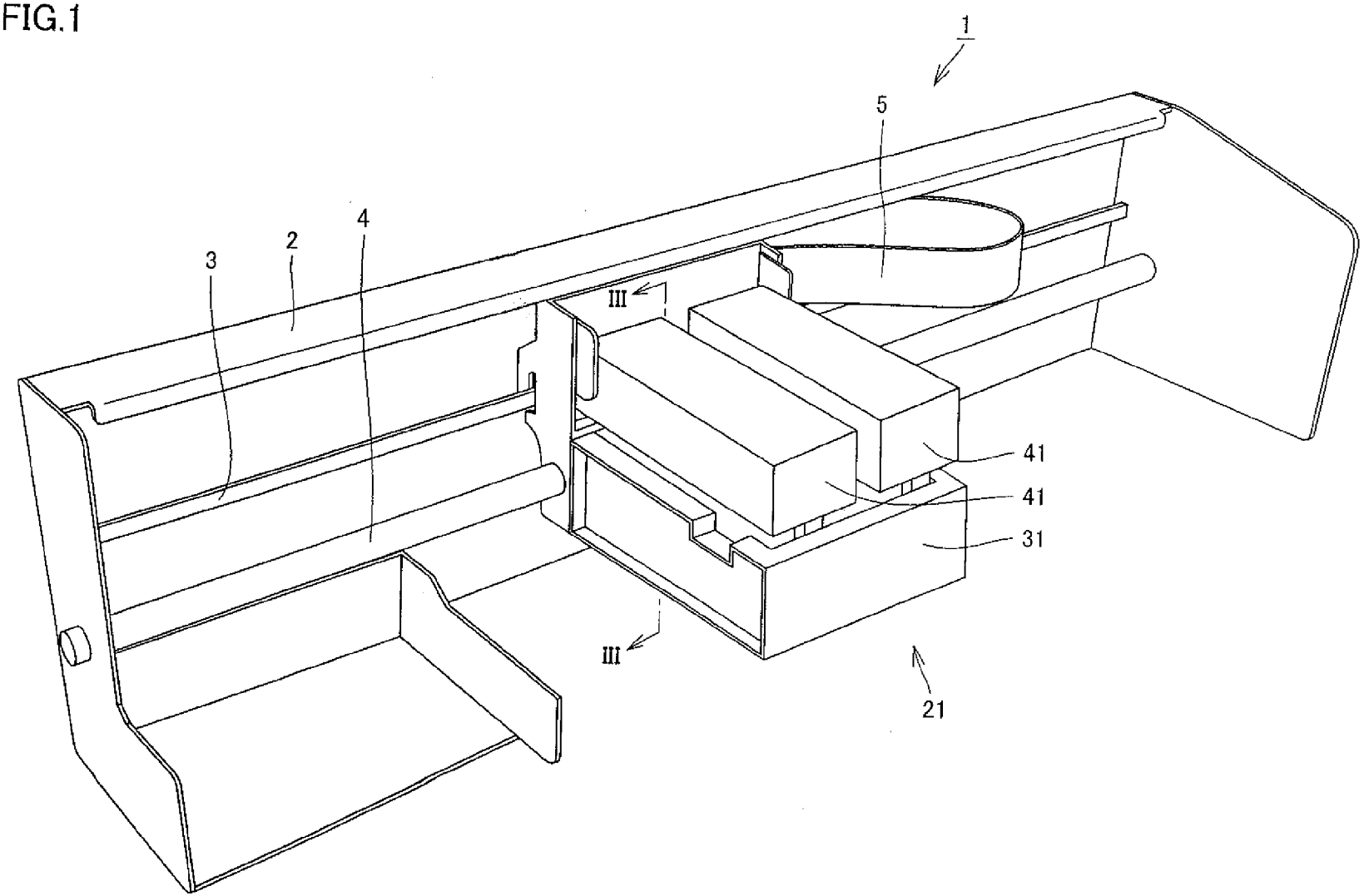
FIG. 1 is a perspective view showing a structure of a main part of an inkjet printer in accordance with an embodiment of the present invention.

In the following, the structure of an inkjet printer in the embodiments of the present invention will be described with reference to the figures. It is noted that in the embodiments the same or corresponding parts will be denoted with the same reference numerals and the description thereof will not be repeated.

First Embodiment

In the following, a first embodiment of the present invention will be described with reference to FIGS. 1 to 3.

Referring to FIG. 1, the structure of the main part of an inkjet printer will be described. As shown in FIG. 1, an inkjet printer in the present embodiment includes a main part 1 having a carriage 21 holding an ink cartridge and being attached movably in the horizontal direction, a guide shaft 4 holding the carriage 21, and a frame 2 to which the guide shaft 4 is fixed.

The guide shaft 4 made of metal passes through carriage 21 so that carriage 21 is guided by guide shaft 4. Carriage 21 is driven by a not-shown motor to slide horizontally along guide shaft 4. The driving force of the motor is transmitted to a belt-holding portion (not shown) on the rear face of carriage 21 through a not-shown belt extending horizontally.

An upright base portion 26 is provided on the rear face side of carriage 21 and a cradle 31 receiving the lower portion of the ink cartridge is attached to the lower portion on the front side. A cover body 41 covering the top portion of the ink cartridge is provided on the upper portion on the front side of base portion 26. Cover body 41 is pivotally attached to base portion 26 and can be opened/closed as necessary.

An encoder strip 3 extending horizontally is positioned on the rear face side of carriage 21, and a sensor (not shown) provided on the rear face of carriage 21 detects a horizontal position of carriage 21. A cable 5 transmitting an electrical signal is connected to carriage 21. The both end portions of guide shaft 4 and the both end portions of encoder strip 3 are fixed to the side wall portions of frame 2.

Figure 2:
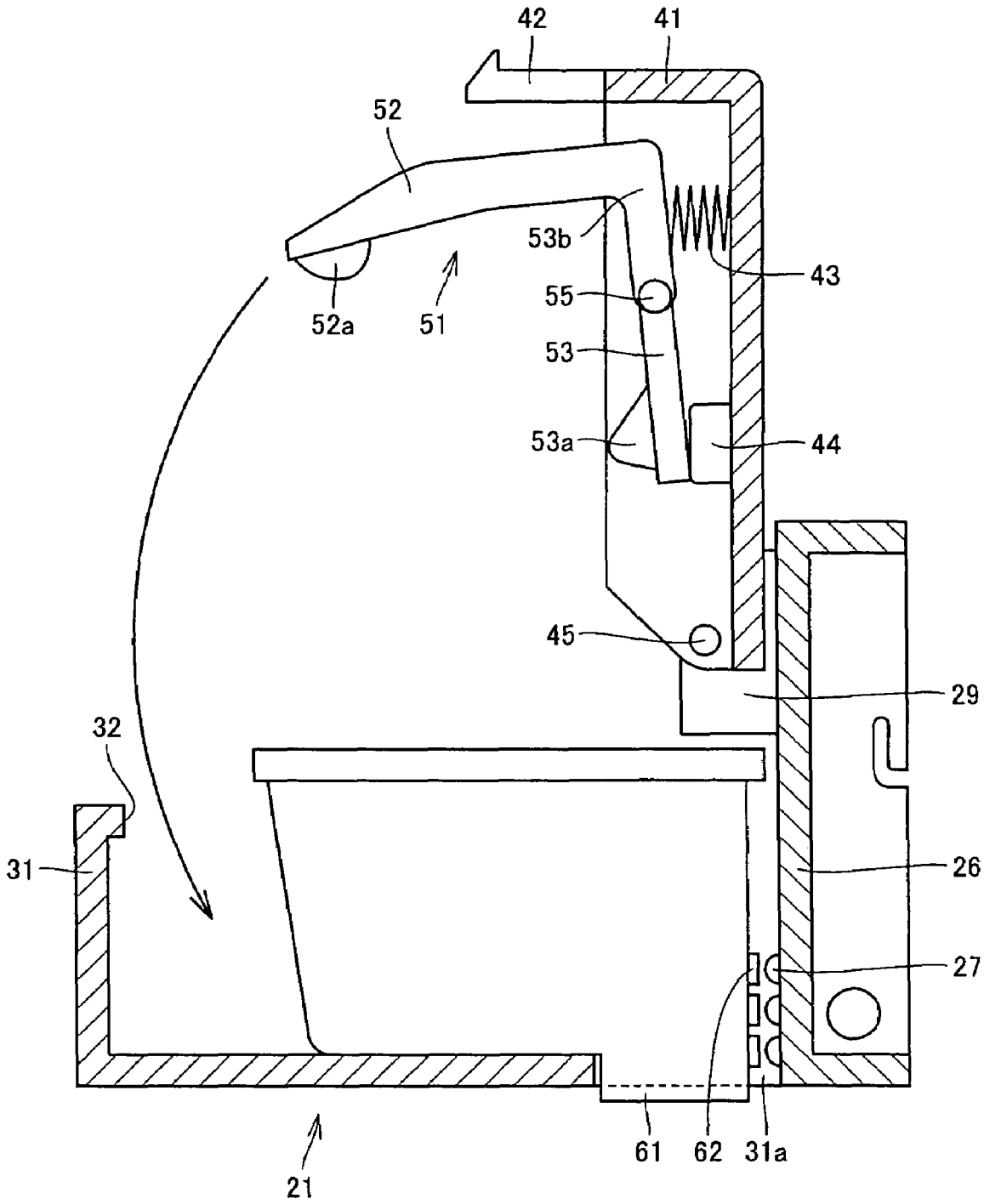
FIG. 2 is a cross sectional view with a cover body of a carriage opened in accordance a first embodiment of the present invention.
Figure 3:
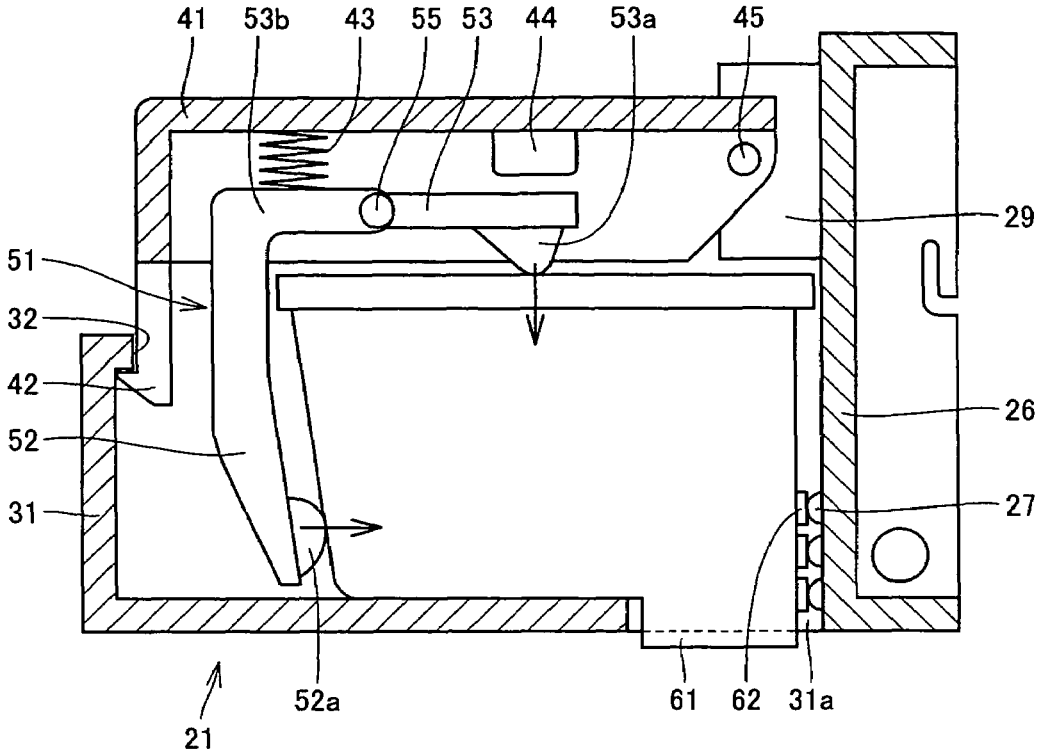
FIG. 3 is a cross sectional view taken along line III-III viewed in the direction of arrows in FIG. 1 with the cover body of the carriage closed in accordance with the first embodiment of the present invention.
Figure 4:
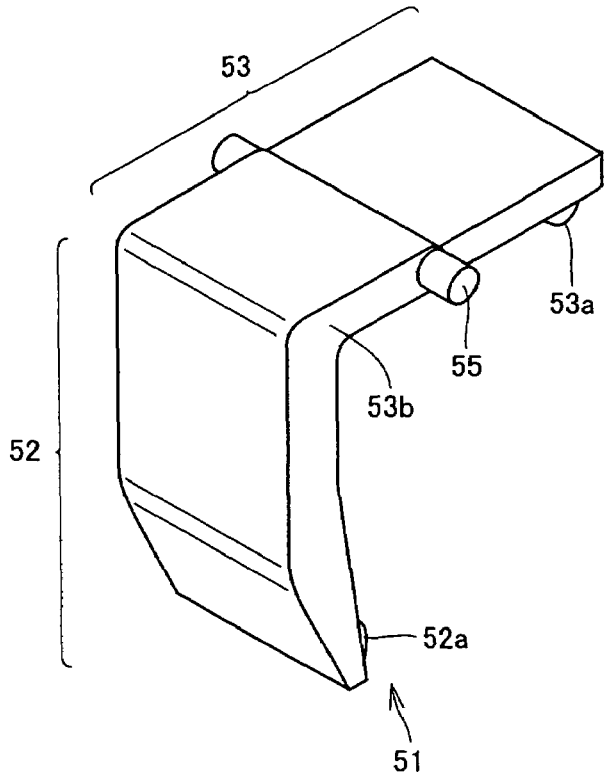
FIG. 4 is a perspective view of a pressing member in accordance with the first embodiment of the present invention.

Referring now to FIGS. 2 to 4, the structure of carriage 21 of the present embodiment will be described in more detail.

A plurality of electrodes 27 are provided on the lower portion on the front side (the left side in FIGS. 2 and 3) of base portion 26 of carriage 21. Electrode 27 is electrically connected to a not-shown control circuit and is brought into contact with an electrode 62 of ink cartridge 61 to send a control signal to ink cartridge 61.

Cradle 31 is fixed on the lower portion on the front side of base portion 26. The end face of cradle 31 is fitted to the front side of based portion 26 and fixed by a not-shown screw or the like. Furthermore, a pair of projecting portions 29 are formed on the upper portion on the front side of base portion 26. Cover body 41 is pivotally attached through a shaft 45 between these projecting portions 29 and 29. It is noted that although in the present embodiment base portion 26 and cradle 31 are separately formed of a resin and fixedly coupled with each other to constitute a carriage body, the carriage body may be integrally formed of a resin.

Cradle 31 is formed of an outer frame and a base plate such that it can hold the lower portion of ink cartridge 61. As shown in FIGS. 2 and 3, an opening portion 31*a* is provided at a part of the underside of cradle 31. The base plate is provided only on the back end side of the underside of cradle 31, and ink cartridge 61 is placed on the top face thereof.

A protrusion 32 in engagement with a locking portion of a locking piece 42 of cover body 41 is provided at the inside of the upper end portion of the front plate of cradle 31. It is noted that the engagement between locking piece 42 of cover body 41 and cradle 31 may be released by directly operating locking piece 42. Alternatively, a release tool for releasing the engagement by pushing back the tip end of locking piece 42 may be provided on the front plate of cradle 31 so that the release tool releases the engagement.

Cover body 41 is pivotally attached to base portion 26 such that it can rotate about shaft 45 upward and downward. Locking piece 42 with a hook-shaped tip end is provided at the tip end portion of cover body 41. Shaft 45 may be provided with a torsion spring wound around shaft 45 for constant biasing in the direction in which cover body 41 opens. In this case, the engagement of locking piece 42 needs only be released in order to open cover body 41.

The tip end and the both sides of the top face of cover body 41 hang down to provide an enclosed space with the underside open within cover body 41. A pressing member 51 and a spring 43 are provided in this space for pressing the back end face and the top face of ink cartridge 61 to fix ink cartridge 61 to carriage 21.

Pressing member 51 is formed of a top face pressing lever 53 and a back end face pressing lever. The top face pressing lever has a first end portion and a second end portion. The first end portion is a plate-like member pressing the top face of ink cartridge 61. The back end face pressing lever is a plate-like member that is continuous to the second end portion of top face pressing lever 53 in the bending direction and has distal end portion 52*a* Pressing the back end face of ink cartridge 61. A cylinder-shaped pin 55 serving as a pivot projects laterally on the both side faces of the intermediate portion of top face pressing lever 53. The pin 55 is inserted in a hole portion provided on the side face of cover body 41. Pressing member 51 is thereby rotatably held to cover body 41 with pin 55 sewing as a pivot. The pressing member 51 is integrally formed of a resin material and shaped in a bending manner as shown in FIG. 4. Here, pin 55 may be formed of a metal shaft or the like passing through the pressing member, rater than being integrally formed.

In the present embodiment, top face pressing lever 53 and back end face pressing lever 52 are continuous to approximately form a right angle. This angle may not be a right angle but may be an acute angle slightly sharper than the right angle.

Spring 43 biasing the second tip end portion 53*b* side from pin 55 serving as the pivot of top face pressing lever 53 is provided between cover body 41 and top face pressing lever 53. Spring 43 biases just the middle portion between pin 55 and second end portion 53*b* of top face pressing lever 53. Spring 43 is fixedly fitted in a not-shown fit portion on the top face of the pressing member. When cover body 41 is closed, back end face pressing lever 52 biased by spring 43 presses the back end face of ink cartridge 61.

First end portion 53*a* of top face pressing lever 53 swells out downward on the underside, and this swelling portion abuts on the top face of ink cartridge 61. The inner face of distal end portion 52*a* of back end face pressing lever 52 also swells out laterally, and this swelling portion abuts on the back end face of ink cartridge 61.

In pressing member 51, the first end portion 53*a* side from pin 55 of top face pressing lever 53 is formed to have smaller flexural rigidity as compared with the second end portion 53*b* side from pin 55. Specifically, the flexural rigidity is reduced by making the thickness of the first end portion 53*a* side from pin 55 of top face pressing lever 53 greater than that of the second end portion 53*b* side from pin 55. Here, means for reducing the flexural rigidity may be provided by reducing the number of reinforcement ribs extending in the lengthwise direction of top face pressing lever 53, or reducing the height or thickness of the reinforcement rib.

With this configuration, the second end portion 53*b* side from pin 55 of top face pressing lever 53 can reliably transmit the biasing force of spring 43 to the back end face of ink cartridge 61 because of its relatively high flexural rigidity. On the other hand, the first end portion 53*a* side from pin 55 of top face pressing lever 53 can elastically deform to some extent because of its relatively small flexural rigidity. Therefore, even with some dimensional deviations of ink cartridge 61 or carriage 21, the top face of ink cartridge 61 can be pressed securely.

The back end face of ink cartridge 61 is pressed forward (the right side in FIGS. 2 and 3) in the operation of inserting ink cartridge 61 through top face pressing lever 53 and back end face pressing lever 52 by means of the biasing force of spring 43. Therefore, ink cartridge 61 is fixed at a prescribed position, and in addition, electrode 62 provided on ink cartridge 61 can be forced into pressure contact with electrode 27 of base portion 26.

When cover body 41 is opened as shown in FIG. 2, the biasing force of spring 43 causes back end face pressing lever 52 to be projected. Unnecessary projection of back end face pressing lever 52 may undesirably cause cover body 41 to be brought into contact with the top face back end portion of ink cartridge 61 when cover body 41 is moved to the closing direction. Therefore, a stopper is provided for preventing back end face pressing lever 52 from projecting further than necessary after being biased by spring 43 in the open state of cover body 41.

This stopper is formed of an abutment body 44 provided on the underside of cover body 41 to abut against first end portion 53*a* of top face pressing lever 53. The abutment of the top face of first end portion 53*a* on abutment body 44 restricts the projection of back end face pressing lever 52, thereby avoiding the unnecessary projection. Accordingly, when cover body 41 is closed, back end face pressing lever 52 can always be brought into abutment with the back end face of ink cartridge 61 from a certain direction, thereby preventing the contact to the top face back end portion of ink cartridge 61.

When ink cartridge 61 is installed, first, ink cartridge 61 is placed on a proper position inside cradle 31. Cover body 41 is then rotated in the closing direction. At this point, distal end portion 52*a* of back end face pressing lever 52 abuts against the back end face of ink cartridge 61, and the biasing force of spring 43 forces ink cartridge 61 to move to a prescribed position as cover body 41 is operated to be closed.

As cover body 41 is further rotated in the closing direction, first end portion 53*a* of top face pressing lever 53 abuts on the top face of ink cartridge 61. Then, when cover body 41 is completely closed, the reaction force created by back end face pressing lever 52 pressing ink cartridge 61 causes top face pressing lever 53 to press the top face of ink cartridge 61 downward. Therefore, ink cartridge 61 is pressed from two directions to be fixed at a proper position within carriage 21.

Carriage 21 in the present embodiment is configured such that two members, that is, one spring 43 and pressing member 51 fix ink cartridge 61, thereby achieving reduction in the number of components. Thus, the assembly processes can be reduced, and in addition, the fabrication costs of carriage 21 can be reduced.

Second Embodiment

Figure 5:
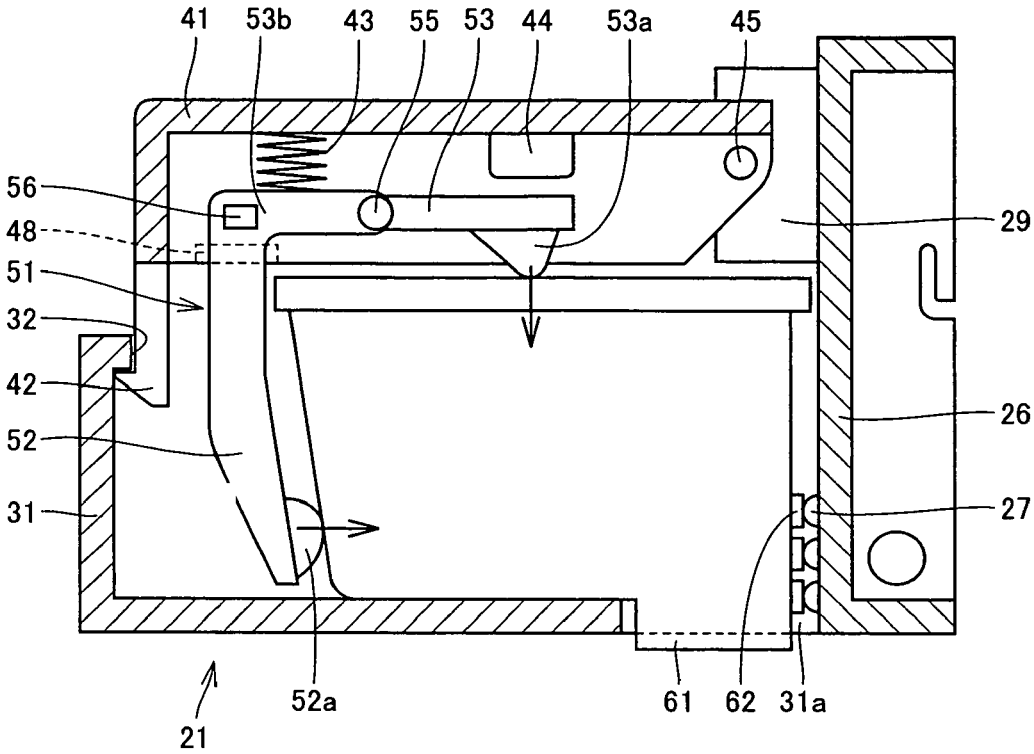
FIG. 5 is a cross sectional view taken along line III-III viewed in the direction of arrows in FIG. 1 with the cover body of the carriage closed in accordance with a second embodiment of the present invention.
Figure 6:
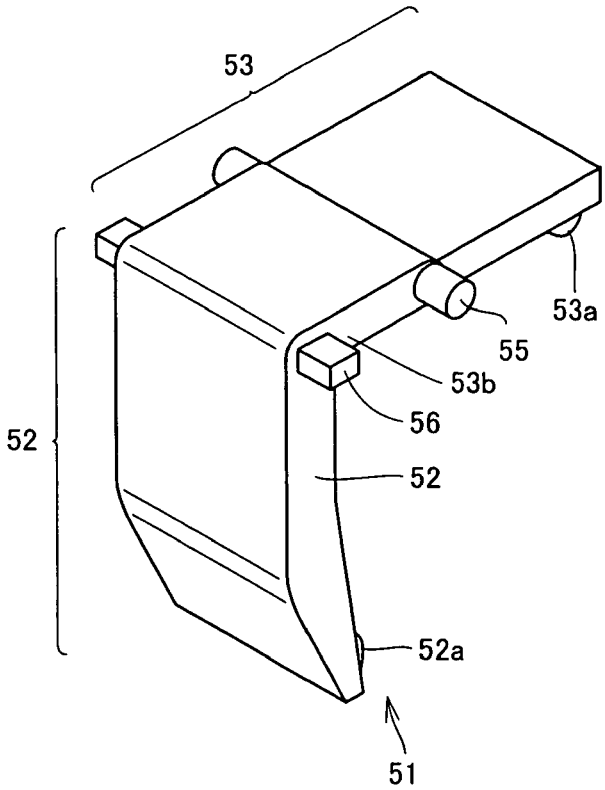
FIG. 6 is a perspective view of the pressing member in accordance with the second embodiment of the present invention.
Figure 7:
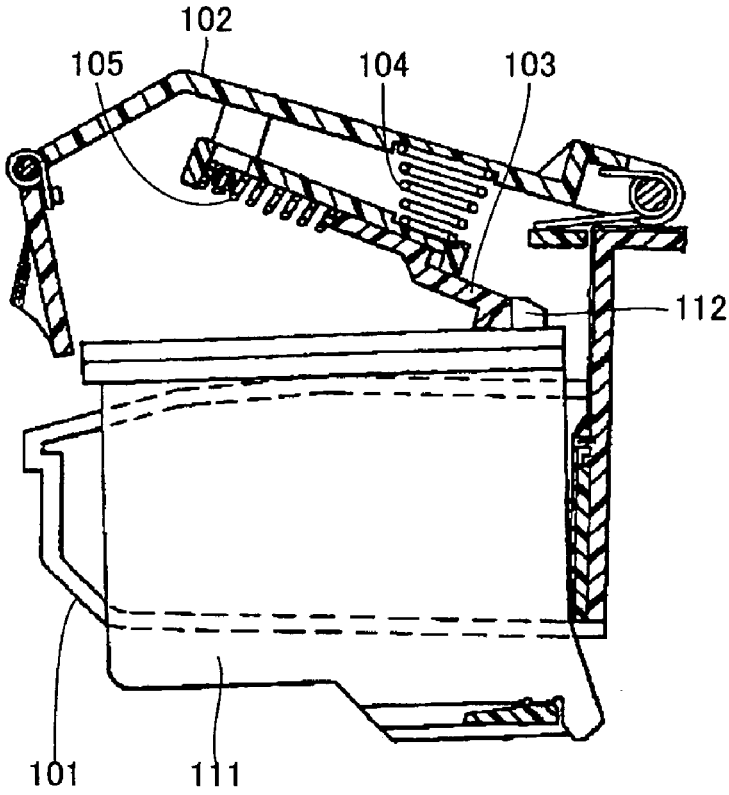
FIG.7 PRIOR ART
FIG. 7 is a cross sectional view showing a structure of a conventional carriage.

A second embodiment will now be described with reference to FIGS. 5 and 6.

In the first embodiment, a stopper is formed of abutment body 44 provided on the underside of cover body 41. Instead, in the present embodiment, a stopper is formed of a protrusion 56 projecting laterally from the side surface of top face pressing lever 53 in the vicinity of second end portion 53*b* and an abutment body 48 in abutment with protrusion 56.

Protrusion 56 horizontally projects on both sides of pressing member 51, and abutment body 48 is provided at each position in abutment with the underside of protrusion 56. When cover body 41 is opened, the underside of protrusion 56 abuts against abutment body 48, thereby preventing spring 43 from projecting further than necessary. Protrusion 56 may be formed integrally with pressing member 51 or may be formed of a metal member passing through pressing member 51 with both ends thereof being projected. Such a stopper can also prevent unnecessary projection of back end face pressing member 52.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An inkjet printer comprising:

a carriage body configured to receive an ink cartridge;

an openable/closable cover body pivotally attached to the carriage body;

a substantially L-shaped pressing member integrally formed of a resin and arranged on an underside of the cover body, the pressing member comprising:

a top face pressing lever having a first end portion configured to press a top face of the ink cartridge and a second end portion; and a back end face pressing lever joined integrally with the top face pressing lever the second end portion thereof, the back end face pressing lever having a distal end portion configured to press a back end face of the ink cartridge, wherein the pressing member is rotatably mounted to the cover body about a pivot defined at an intermediate portion of the top face pressing lever;

a spring disposed between the cover body and the top face pressing lever for biasing the second end portion of the top face pressing lever away from the carriage body, such that the distal end portion of the back end face pressing lever presses the back end face of the ink cartridge when the cover body is closed; and a stopper arranged to prevent the back end face pressing lever from projecting further than necessary when the cover body is opened, wherein the first end portion of the top face pressing lever is formed to have smaller flexural rigidity as compared with the second end portion such that an elastic force of the first end portion causes the first end portion to press the top face of the ink cartridge when the cover body is closed.

2. The inkjet printer according to claim I, wherein the first end portion of said top face pressing lever includes a swelling portion that swells out downward and abuts the top face of the ink cartridge.

3. The inkjet printer according to claim 2, wherein the distal portion of the back end face pressing lever includes a swelling portion that swells out laterally and abuts on the back end face of the ink cartridge.

4. An inkjet printer comprising a carriage body configured to receive an ink cartridge;

an openable/closable cover body pivotally attached to the carriage body;

a substantially L-shaped pressing member arranged on an underside of the cover body, the pressing member comprising:

a top face pressing lever having a first end portion configured to press a top face of the ink cartridge and a second end portion; and a back end face pressing lever joined integrally with the top face pressing lever to the second end portion thereof, the back end face pressing lever having a distal end portion configured to press a back end face of the ink cartridge, wherein the pressing member is rotatably mounted to the cover body about a pivot defined at an intermediate portion of the top face pressing lever; and a spring disposed between the cover body and the top face pressing lever for biasing the second end portion side of the top face pressing lever away from the carriage body, sue that the distal end portion of the back end face pressing lever presses the back end face of the ink cartridge when the cover body is closed.

5. The inkjet printer according to claim 4, wherein the first end portion of the top face pressing lever is formed to have smaller flexural rigidity as compared wit the second end portion.

6. The inkjet printer according to claim 4, further comprising a stopper arranged to prevents the back end face pressing lever from projecting farther than necessary when their cover body is opened.

7. The inkjet printer according to claim 6, wherein the stopper is an abutment body provided on the underside of the cover body in abutment with the first end portion of the top face pressing lever.

8. The inkiest printer according to claim 4, wherein the stopper is protrusion projecting laterally from a side face of the top face pressing lever in the vicinity of the second end portion and an abutment body in abutment with the protrusion.

9. The inkjet printer according to claim 2, wherein the first end portion of the top face pressing lever includes a swelling portion that swells out downward and abuts the top face of the ink cartridge.

10. The inkjet printer according to claim 8, wherein the distal portion of the back end face pressing lever includes a swelling portion that swells out laterally and abuts on the back end face of the ink cartridge.

* * * * *